United States Patent [19]

Ainoya

[11] Patent Number: 4,943,863

[45] Date of Patent: Jul. 24, 1990

[54] ELECTROPHOTOGRAPHIC PRINTER

[75] Inventor: Masayuki Ainoya, Katsuta, Japan

[73] Assignee: Hitachi Koki Co., Ltd., Tokyo, Japan

[21] Appl. No.: 400,623

[22] Filed: Aug. 30, 1989

[30] Foreign Application Priority Data

Sep. 2, 1988 [JP] Japan ..... 63-220745

[51] Int. Cl.[5] ..... G03G 15/14; G03G 21/00

[52] U.S. Cl. ..... 355/271; 355/309; 355/315

[58] Field of Search ..... 355/271, 274, 277, 308, 355/309, 315

[56] References Cited

U.S. PATENT DOCUMENTS

| | | | |
|---|---|---|---|
| 3,988,536 | 12/1976 | Kaupp . | |
| 4,110,027 | 8/1978 | Sato et al. | 355/274 |
| 4,131,358 | 12/1978 | Windele | 355/274 |
| 4,213,551 | 7/1980 | Windele | 355/309 X |
| 4,306,800 | 12/1981 | Kopp | 355/271 |
| 4,362,378 | 12/1982 | Erskine et al. | 355/309 X |
| 4,699,496 | 10/1987 | John et al. | 355/277 |
| 4,809,033 | 2/1989 | Ikemoto et al. | 355/271 |

*Primary Examiner*—Fred L. Braun
*Assistant Examiner*—Sandra L. Hoffman
*Attorney, Agent, or Firm*—Sughrue, Mion, Zinn, Macpeak & Seas

[57] ABSTRACT

An electrographic printer for printing an image on a continuous printing sheet having a leading edge and a tail edge, the printer including a photosensitive drum, a tractor for feeding the continuous printing sheet to the photosensitive drum, a guide member positioned at an image transfer position and disposed movable toward and away from the photosensitive drum for providing an intimate contact of the printing sheet with the photosensitive drum so as to transfer a toner image on the drum to the printing sheet, a fixing section for fixing a transferred toner image on the printing sheet, a sheet stacker and a feed roller for feeding an image fixed sheet to the sheet stacker, and means for changing a gap between the guide member and the photosensitive drum. The changing means enlarges the gap until the leading edge of the printing sheet passes through the feed roller, and reduces the gap after the leading edge passes through the feed roller. The printer further includes means for changing sheet feeding speed of the feed roller lower than the sheet feeding speed of the tractor after the tail edge of the printing sheet passes through the tractor, whereby a printing to a tail edge portion of the printing sheet is performable.

6 Claims, 2 Drawing Sheets

ELECTROPHOTOGRAPHIC PRINTER

BACKGROUND OF THE INVENTION

The present invention relates to an electrophotographic printer, and more particularly, to a type thereof which can effect printing on leading and trailing portions of continuous web-like printing sheet without unprinted or idle zones at these portions.

One conventional electrophotographic printer is shown in FIG. 1. A tractor 21 is drivingly connected to drive motor 22 for feeding a printing sheet (not shown) toward a printing section. The printing section includes a photosensitive drum 1, a charter 2, a developer 4 in which toners ere accumulated, and an image transferring means 7 such as transferring corotoron. These charger 2, developer 4 and the transferring means 7 are disposed around the photosensitive drum 1. An electrostatic latent image is formed on the photosensitive drum 1 by a laser beam, light emitting diode array, or combination of a light source and a liquid crystal shutter etc., and a toner image corresponding to the latent image is formed on the drum 1. The toner image is then transferred onto the printing sheet by the transferring corotoron 7.

At the downstream side of the printing section, a fixing unit is provided which includes a flash lamp 20. By the fixing unit, toner image outputted on the printing sheet is thermally fixed. Further, a drive motor 17 is provided for driving a transfer roller 19. The transfer roller 19 has a constant peripheral speed slightly faster than the sheet delivering speed given by the tractor 21 so as to avoid sheet slack. At an exit side of the printer, a sheet stacker 18 is provided into which the continuous printing sheet is successively folded and stacked.

A sheet guide member 6 is disposed at an inlet portion of the photosensitive drum 1. The sheet guide member 6 is positioned at both upstream and downstream sides of the transferring corotoron 7, and is pivotally supported to a frame body (not shown) by a pivot shaft 8. Therefore, the guide member 6 is movable toward and away from the photosensitive drum surface about the pivot shaft 8 so as to provide intimate contact of the printing sheet with the drum 1. Further, the sheet guide member 6 has an intermediate portion pivotally connected to one end of a link 11. The link 11 has another end pivotally connected to a cam 10 which is driven by a motor 9. Therefore, the sheet guide member 6 is movable toward and away from the outer peripheral surface of the photosensitive drum 1. A gap having a distance of about 0.5 mm is maintained between the photosensitive drum 1 and the sheet guide member 6 so as to maintain intimate contact between the printing sheet end the drum 1. Such small gap can withstand tension applied to the sheet during printing. Incidentally, desirable image transfer cannot be achieved unless the sheet is in intimate contact with the photosensitive drum. In this connection, the gap distance between the sheet guide member 6 and the photosensitive drum 1 must be within a range of 0.5 mm to 1.2 mm. In case of the cut sheet, the sheet can be sticked onto the photosensitive drum because of the electrostatic force. Therefore, the gap distance of not less than 0.8 mm is also available. However, in case of the continuous sheet, the gap distance must be not more than 0.8 mm, otherwise the sheet may be displaced from the exact printing region, since precedent portion of the continuous sheet is held by the transfer roller 19 and therefore the tension is imparted on the sheet.

SUMMARY OF THE INVENTION

With such conventional electrophotographic printer, unprinted portion or waste pages may be provided at leading portion and trailing portion of the continuous sheet, and therefore, several pages cannot undergo printings at these portions. Such drawbacks occur for the following reasons:

In the conventional printer, the gap distance between the sheet guide member and the photosensitive drum is maintained by about 0.5mm so as to provide the intimate contact between the continuous sheet and the photosensitive drum. With such small gap, it would be rather difficult to introduce a leading edge portion of the sheet into the printing section (the leading edge cannot be easily passed through the minute gap). In this connection, the sheet guide member 6 must be retracted by the actuation of the cam 10 and the link 11 so as to provide a sufficient open space until the continuous sheet is delivered into the printing section by a predetermined length. Then, due to the large gap, it would be impossible to provide the intimate contact between the sheet and the photosensitive drum 1 with respect to the several top page zones which has been already introduced into the printing section. As result, it becomes impossible to start printing at the top page section of the continuous sheet.

Even if printing can be achieved at the top page section, then, the top page section may round the photosensitive drum 1, since the leading edge of the sheet cannot be desirably oriented toward the fixing unit 20. That is, the no urging force is applied to the leading edge so as to correctly introduce the leading edge to the sheet transfer roller 19.

Further, if the printing sheet can be introduced toward the fixing unit by the accidental separation of the sheet from the photosensitive drum 1, the sheet carrying an output image may be in slide contact with an ambient cover member disposed upstream of the fixing unit 20. Accordingly, printing image may be degraded. This is due to the fact that the leading edge of the sheet is freely movable until the leading edge reaches the transfer roller 19 and is nipped thereby.

Furthermore, even if the printing sheet can reach the transfer roller 19, the travelling speed of the sheet is varied immediately when the leading edge of the sheet is nipped by the transfer roller, since the peripheral rotation speed of the transfer roller 19 may be slightly different from the travelling speed of the sheet. Even though, as described above, the peripheral speed of the transfer roller 19 is determined on the basis of the moving speed of the tractor 21. However, since the leading edge of the sheet is not guided but is freely moved until it reaches the transfer roller 19, the sheet travelling speed is immediately changed at the time of nipping by the roller 19. Such speed change may affect printing, and blurring may occur in the output image.

After the continuous printing, the trailing edge of the continuous sheet may be separated from the &reactor 21. Prior to this separation, the sheet is delivered to the printing section by the travelling speed of the tractor 21. However, after the sheet is separated from the tractor 21, then the sheet travelling speed is predominant on the peripheral speed of the transfer roller 19. In this connection, since the peripheral speed of the transfer roller 19 is faster than the travelling speed of the tractor 21, the printed image may be elongated in travelling direction of the sheet. More specifically, peripheral rotation speed of the photosensitive drum must be coincident with the travelling speed of the sheet in order to obtain correct printing image. Therefore, the moving speed of the tractor 21 is set equal to the peripheral rotation speed of the photosensitive drum 1. However, after the sheet is released from the tractor, the sheet is delivered by the urging of the discharge roller 19 whose peripheral speed is faster than that of the photosensitive drum 1.

In view of the above, in the conventional electrophotographic printer, it would be impossible to perform printing on leading and trailing portions of the continuous sheet which portions include several top page sections and last page sections. Therefore, in the conventional printer, unprinted sections may be provided, or low grade printing may result at these top and last page sections in the continuous sheet.

The present invention is established on a basis of various findings of the drawbacks attendant to the conventional printer, and therefore, it is an object of the present invention to provide an improved electrophotographic printer which is capable of performing printing on both leading and trailing portions of the continuous sheet.

Another object of the present invention is to provide such improved printer which can effect printing on both leading and trailing edge portions of the continuous sheet with avoiding degradation of the output printing image these portions.

In accordance with the present invention, attention is drawn to a sheet feed mechanism in a cut sheet printer, and sheet separation mechanism is incorporated for separating the printed sheet from the photosensitive drum surface, and further, attention is also drawn to the relationship between a motion of a sheet guide member and a travelling speed of the continuous sheet.

These and other objects of the present invention will be attained by providing an electrographic printer for printing an image on a continuous printing sheet having a leading edge and a tail edge, the printer including a photosensitive drum which provides a toner image on its surface, a tractor for feeding the continuous printing sheet to the photosensitive drum the tractor having a given sheet feeding speed, guide member positioned at an image transfer position and disposed movable toward and away from the photosensitive drum for providing an intimate contact of the printing sheet with the photosensitive drum so as to transfer the toner image to the printing sheet, a gap being defined between the guide member and the photosensitive drum and a toner image transfer section being defined between the photosensitive drum and the guide member, a fixing section for fixing a transferred toner image on the printing sheet, a sheet stacker and a feed roller for feeding an image fixed sheet to the sheet stacker; the improvement comprising: means for changing the gap between the guide member and the photosensitive drum, the changing means enlarging the gap until the leading edge of the printing sheet passes through the feed roller, and reducing the gap after the leading edge passes through the feed roller, whereby printing to the leading edge portion is performed.

In another aspect, there is provided an electrographic printer for printing an image on a continuous printing sheet having a leading edge and a tail edge, the printer including photosensitive drum which provides a toner image on its surface, a tractor for feeding the continuous printing sheet to the photosensitive drum the tractor having a given sheet feeding speed, a guide member positioned at an image transfer position and disposed movable toward and away from the photosensitive drum for providing an intimate contact of the printing sheet with the photosensitive drum so as to transfer the toner image to the printing sheet, a gap being defined between the guide member and the photosensitive drum and a toner image transfer section being defined between the photosensitive drum and the guide member, a fixing section for fixing a transferred toner image on the printing sheet, a sheet stacker and a feed roller for feeding an image fixed sheet to the sheet stacker; the improvement comprising: means for changing sheet feeding speed of the feed roller lower than the sheet feeding speed of the tractor after the tail edge of the printing sheet passes through the tractor, whereby m printing to a tail edge portion of the printing sheet is performable.

DETAILED DESCRIPTION OF THE PREFERRED EMBODIMENT

Figure 1:
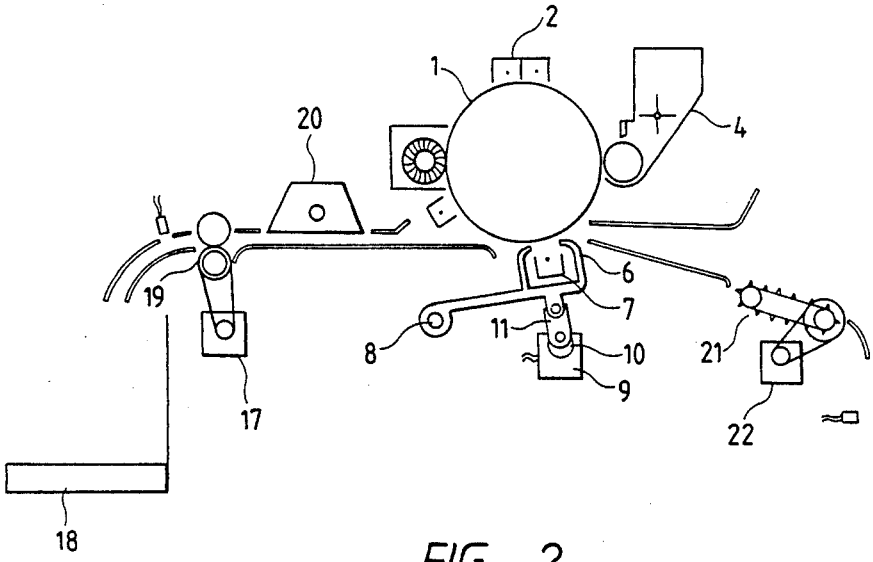
FIG. 1 PRIOR ART
FIG. 1 is a schematic side elevational view showing a conventional electrophotographic printer.
Figure 2:
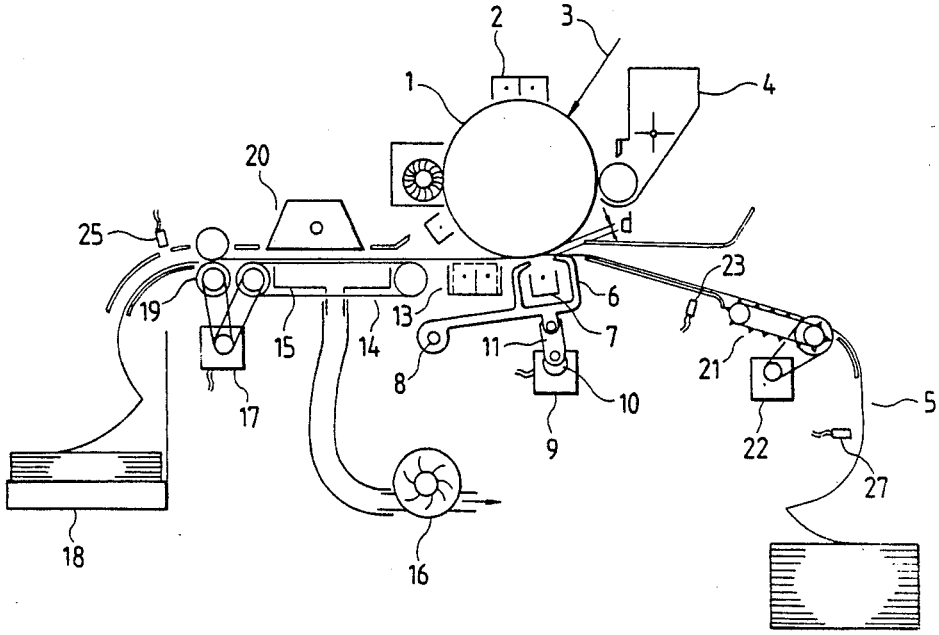
FIG. 2 is a schematic side elevational view showing an electrophotographic printer in its steadily operational phase according to one embodiment of this invention.

An electrophotographic printer according to one embodiment of this invention will be described with reference to FIGS. 2 thru 4, wherein like parts end components are designated by the same reference numerals and characters as those shown in FIG. 1. Similar to the conventional printer, this embodiment includes a tractor 21, a drive motor 22, a photosensitive drum 1 to which a laser beam 3 is applied, a charter 2, a developer 4, a sheet guide member 6, a transfer corotoron 7, a fixing unit including a flash lamp 20, a drive motor 17 for driving a transfer roller 19 and a sheet stacker 18. The sheet guide member 6 is pivotally movable about a pivot shaft 8 by means of a link 11, a cam 10 and a drive motor 9 similar to the conventional printer. A gap d is provided between the sheet guide member 6 and the photosensitive drum 1. The gap distance is changeable by the motor 9, the cam 10 and the link 11.

A continuous sheet 5 is formed with a plurality of lateral perforations lines, and a single page is defined between the neighbouring perforation lines. The continuous sheet 5 has a leading edge portion 24 and a trailing edge portion 26. In the embodiment, there are further provided a first sheet leading edge sensor 23 disposed upstream of the photosensitive drum 1, a second sheet leading edge sensor 25 disposed downstream of the transfer or feed roller 19, and a sheet tail edge sensor 27 disposed upstream of the tractor 21. Further, in the present invention, a separation means 13 such as a separation corotoron is disposed at downstream side of the transfer means 7. The separation means 13 is adapted for separating the printed sheet from the photosensitive drum which printed sheet 5 has been electrostatically adhered thereto. The separation means 13 is at least operable until the leading edge of the sheet reaches to the transfer roller 19.

The fixing unit includes the flash lamp 20, a casing 15, a transfer belt such as an endless belt 14 accommodated in the casing 15, a blower 16 in fluid communication with an interior of the casing 15. The transfer belt 14 is driven by the drive motor 17. The blower 16 provides a negative pressure within the casing 15, so that the printed sheet can be sticked onto the transfer belt 14.

As is well known, the photosensitive drum is precharged by the charger 2, and is exposed to light by the laser beam 3, so that an electrostatic latent image is provided on an outer peripheral surface of the drum 1. Then, toner image is provided on the drum by the developer 4, and the toner image is transferred Onto the sheet 5 at the transferring section constituted by the transfer corotoron 7 and the sheet guide member 6. The guide member 6 primarily serves to provide an intimate contact between the sheet 5 and the drum 1, and the transfer corotoron 7 is adapted to electrostatically adhere toner particles on the drum onto the sheet 5.

In the present embodiment, the gap d defined between the guide plate 6 and the photosensitive drum 1 is changeable in accordance with the travelling phase of the continuous sheet. Further, moving speeds of the transfer belt 14 and the transfer roller 19 are also changeable. On the other hand, peripheral rotation speed of the drum 1 and the moving speed of the tractor 21 are maintained unchanged. As described above, the gap distance d is preferably 0.5 mm for the desirable printing in case of the continuous sheet. However, it has been confirmed that desirable printing is also achievable within the gap distance of 1.2 mm. Here, in the conventional printer, if such large gap distance is given, for example, if the gap distance exceeds 0.8 mm, the sheet may be displaced toward the sheet guide member, so that the sheet 5 is moved away from the photosensitive drum 1, since tension is applied to the sheet because of the nip driving by the transfer roller 19. However, in the present invention, such drawback can be eliminated in spite of the gap distance ranging from 0.5 to 1.2 mm for the reasons described leter. Incidentally, in case of the cut sheet, no tension is applied to the cut sheet, and therefore, the gap distance of not less than 0.8 mm is also available for printing.

The first sensor 23 detects the leading edge of the continuous sheet 5 and sends the detection signal to control circuit (not shown). The control circuit generates a signal indicative of a data priting start timing of the laser beam 3 with respect to the drum 1, operational timing of the sheet guide plate 6, and ON timings of the transfer corotoron 7 and the separation corotoron 13. The second sensor 25 detects the leading edge of the printing sheet 5 and sends the detection signal to the control circuit. In response to the leading edge detection signal, the control circuit (not shown) generates a signal indicative of the termination of the printing operation after printing on a specific page section is completed. That is, the specific page section is defined by a precedent perforation line and a subsequent perforation lines. When the subsequent perforation line is brought into alignment with the central portion of the transfer section, the printing operation is temporarily suspended in response to the signal from the control circuit.

The third sensor 27 detects the trailing edge of the continuous sheet 5, and sends the detection signal to the control circuit. After time elapsing counting from the tail edge detection timing, for example, after the tail edge reaches an inlet or downstream end portion of the tractor 14 (at the time when the trailing edge of the sheet 5 is separated or departs from the tractor 21), the feed speed of the transfer belt 14 and the feed roller 19 is lowered by a signal from the control circuit, so as to effect printing on the last page section(s) at the reduced sheet feeding speed.

Operation mode will next be described.

The top page section 24 of the continuous sheet 5 is assembled to the tractor 21, and a start button (not shown) is depressed for starting the printing operation. Then, the motor 22 is energized to move the tractor 21 in a direction toward the printing section as indicated by an arrow. When the leading edge of the sheet 5 passes the first sensor 23, the sensor generates signal indicative of the data writing timing, operation timing of the sheet guide member 6, and ON timings of the transfer corotoron 7 and the separation corotoron 13. In this case, the gap distance d is in a range of from 0.8 mm to 1.2 mm. This gap distance is relatively larger then the conventional gap. Therefore, the leading edge of the sheet can be smoothly introduced into the image transfer section. Further, this gap distance (0.8 to 1.2mm) has been considered to be impossible for printing in the conventional printer. However, in the present invention, since the leading edge of the sheet is not held or gripped by the mechanical component such as the transfer roller at the initial phase of the printing, no tension is applied to the sheet 5, and therefore, desirable printing is achievable even at the top page section under such relatively large gap.

The top page section 24 is subjected to printing by the toner transfer from the photosensitive drum 1 by means of the transfer corotoron 7, and the thus printed sheet passing through the sheet guide plate is separated from the photosensitive drum 1 by means of the separation corotoron 13. Since the sheet 5 is imparted with electrostatic force at the image transfer section, the sheet 5 is then smoothly introduced onto the transfer belt 14. Further, even though the leading edge of the sheet is not subjected to any directional force, the sheet can be oriented toward the transfer belt 14 by means of the transfer corotoron 7.

In this state, the feeding speed of the transfer belt 14 and the peripheral rotation speed of the transfer roller 19 are set slightly lower than the peripheral rotation speed of the photosensitive drum 1 by about 0 to 2 %. Therefore, the sheet pulling force generated by these transfer belt 14 and the transfer roller 19 does not effect the image transfer operation. That is, no overtension is applied to the sheet which overtension may adversely produce elongated printing image. Further, in this case, since the leading edge portion of the continuous sheet 5 is held by the transfer belt 14 because of the negative pressure generated by the blower 16, no sheet floating occur, and therefore, subsequent page sections are not in slide contact with the embient component around the flash lamp 20. Accordingly, resultant output image having high quality is obtainable. The thus printed sheet 5 is foldably accumulated in the stacker 18.

Figure 3:
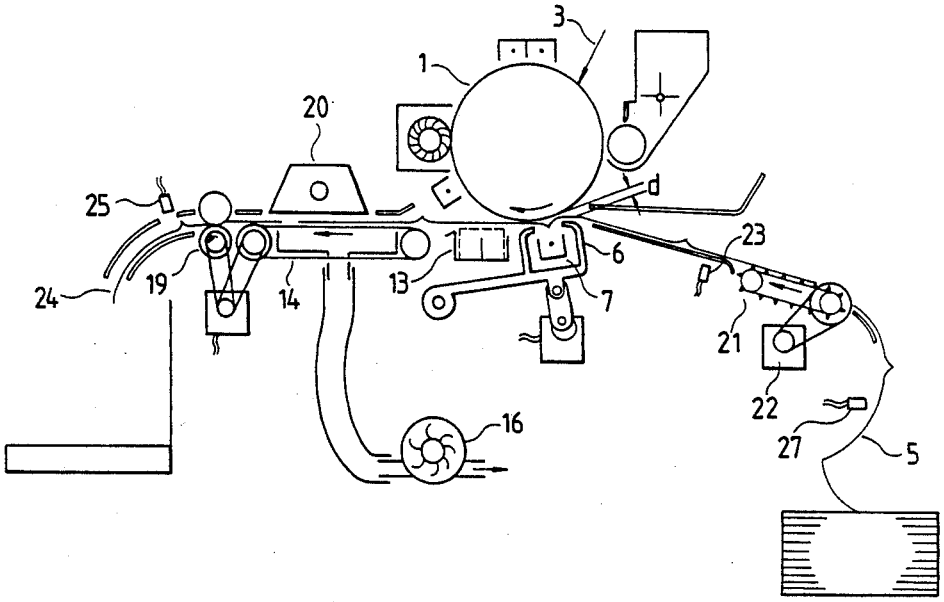
FIG. 3 is a schematic side elevational view showing an electrophotographic printer and showing a phase of leading edge portion printing according to the present invention and FIG. 4 is a schematic side elevational view showing an electrophotographic printer and showing a phase of trailing edge portion printing according to the present invention.
Figure 4:
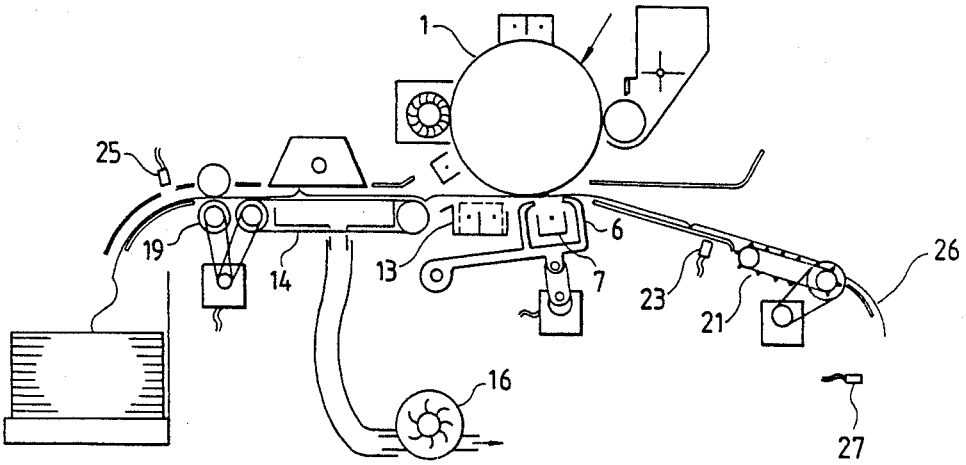

As shown in FIG. 3, when the leading edge of the printing sheet 5 passes the second sensor 25, the sensor 25 detects the leading edge and the control circuit generates the signal for temporarily suspending the printing operation after the specific page section undergoes full printing. That is, in accordance With the image data written on the photosensitive drum 1 by the laser beam 3, the toner image on the drum is completely transferred onto the specific page section, and when the bottom perforation line of the page section is brought into alignment with the center portion of the image transfer section, the printing operation is temporarily suspended in response to the signal from the control circuit. In this case, the blower 16 is rendered OFF, since the leading edge portion of the sheet has been held by the sheet transfer roller 19. At the same time, the sheet guide plate 6 is retracted to its lowermost position so as to provide the gap distance d of 3 to 4 mm.

Thereafter, feeding speeds of the transfer belt 14 and the transfer roller 19 are changed to be 2 to 10 % faster than the peripheral rotation speed of the photosensitive drum 1 in order to absorb sheet slacking. Then, the sheet guide member 6 is again pivotally moved about the pivot shaft 8 so that gap distance d becomes 0.5 mm. Accordingly, subsequent printing operation can be started in the conventional manner. In other words, after the leading edge section of the continuous sheet 5 is held by the transfer roller 19, the conventional printing mode is also available in the present invention.

Next, printing to the last page section 26 and several last page sections if any will be described with reference to FIG. 4. Printing is continued at the above sheet feeding speed with respect to a sheet section preceeding the last page section, the preceeding sheet section having a length corresponding to a length between the third sensor 27 and the inlet of the tractor 21 (here, the term "inlet" is used with respect to the image transfer means 7. If viewing only the tractor, the inlet is positioned at downstream end of the tractor). That is, until the tail edge of the sheet 5 reaches the inlet or downstream end of the tractor 21, the preceeding sheet section is subjected to printing at the ordinary sheet feeding mode. However, after the elapse of time counting from the tail edge detection by the third sensor 27, i.e., after the tail edge reaches the tractor inlet, the feeding speed of the transfer belt 14 and the transfer roller 19 is changed to a speed slightly lower than the peripheral rotation speed of the photosensitive drum 1 by about zero to 2% so as to effect printing on the last page section or several last page sections if any ending at the tail edge. Here, the tractor 21 does not serve to feed the sheet, but only the drum 1 serves for feeding the sheet. Further, at the same time, the blower 16 at the transfer belt 14 is rendered ON for the subsequent printing operation with respect to the last page section.

In the foregoing embodiment, the blower 16 is rendered ON when the top and last page sections are to be printed so as to pneumatically clamp the sheet, and during the normal printing operation, the blower 16 can be rendered OFF. However, the blower 16 can be always actuated for continuously urging the sheet away from the mechanical components in the section 20.

In view of the foregoings, according to the present invention, printings to the first and last page sections in the continuous sheet are attainable, and therefore, printings can be made at low cost without any wastes of sheet page and attendant expendables.

What is claimed is:

1. In an electrographic printer for printing an image on a continuous printing sheet having a leading edge and a tail edge, the printer including a photosensitive drum which provides a toner image on its surface, a tractor for feeding the continuous printing sheet to the photosensitive drum the tractor having a given sheet feeding speed, a guide member positioned at an image transfer position and disposed movable toward and away from the photosensitive drum for providing an intimate contact of the printing sheet with the photosensitive drum so as to transfer the toner image to the printing sheet, a gap being defined between the guide member and the photosensitive drum and toner image transfer section being defined between the photosensitive drum and the guide member, a fixing section for fixing a transferred toner image on the printing sheet, a sheet stacker and a feed roller for feeding an image fixed sheet to the sheet stacker; the improvement comprising:

means for changing the gap between the guide member and the photosensitive drum, the changing means enlarging the gap until the leading edge of the printing sheet passes through the feed roller, and reducing the gap after the leading edge passes through the feed roller, whereby printing to the leading edge portion is performed.

2. The improvement as claimed in claim 1, further comprising a sheet separation means provided adjacent the photosensitive drum and disposed between the transfer section and the fixing section.

3. The improvement as claimed in claim 2, wherein the sheet separation means comprises a separation corotoron which is operable until the leading edge reaches the feed roller.

4. The improvement as claimed in claim 1, wherein the feed roller provides a first feeding speed lower than the sheet feed speed of the tractor until the leading edge reaches the feed roller, and a second feeding speed higher than the sheet feeding speed of the tractor after the leading edge reaches the feed roller.

5. In an electrographic printer for printing an image on a continuous printing sheet having a leading edge and a tail edge, the printer including a photosensitive drum which provides a toner image on its surface, a tractor for feeding the continuous printing sheet to the photosensitive drum the tractor having a given sheet feeding speed, a guide member positioned at an image transfer position and disposed movable toward and away from the photosensitive drum for providing an intimate contact of the printing sheet with the photosensitive drum so as to transfer the toner image to the printing sheet, a gap being defined between the guide member end the photosensitive drum and a toner image transfer section being defined between the photosensitive drum and the guide member, a fixing section for fixing a transferred toner image on the printing sheet, sheet stacker and a feed roller for feeding an image fixed sheet to the sheet stacker; the improvement comprising:

means for changing sheet feeding speed of the feed roller lower than the sheet feeding speed of the tractor after the tail edge of the printing sheet passes through the tractor, whereby a printing to a tail edge portion of the printing sheet is performable.

6. The improvement as claimed in claim 5, wherein the sheet feeding speed of the feed roller is from zero to 2% lower than the sheet feeding sped of the tractor after the tail edge of the printing sheet passes through the tractor.

* * * * *